US009664468B1

(12) United States Patent
Johnson et al.

(10) Patent No.: US 9,664,468 B1
(45) Date of Patent: May 30, 2017

(54) CONTROL OF EJECTED FIREARM SHELLS

(71) Applicants: Darrin S. Johnson, Springfield, OR (US); Paul E. Johnson, Springfield, OR (US)

(72) Inventors: Darrin S. Johnson, Springfield, OR (US); Paul E. Johnson, Springfield, OR (US)

( * ) Notice: Subject to any disclaimer, the term of this patent is extended or adjusted under 35 U.S.C. 154(b) by 0 days.

(21) Appl. No.: 15/183,718

(22) Filed: Jun. 15, 2016

(51) Int. Cl.
*F41A 15/00* (2006.01)
*F41A 9/56* (2006.01)

(52) U.S. Cl.
CPC ..... *F41A 9/56* (2013.01)

(58) Field of Classification Search
CPC ..... F41A 15/00; F41A 9/60; F41A 9/56
USPC ..... 42/90, 98
See application file for complete search history.

(56) References Cited

U.S. PATENT DOCUMENTS 3,603,015 A * 9/1971 Jensen ..... F41A 9/60 42/98
3,658,241 A 4/1972 Pistocchi
3,733,728 A * 5/1973 Kuslich ..... F41A 9/60 42/98
3,755,946 A 9/1973 Tomlinson et al.
3,771,248 A 11/1973 Linehan
3,807,075 A 4/1974 Mylonas
3,964,198 A 6/1976 Waddell
3,978,602 A * 9/1976 Morrow ..... F41A 15/00 42/98
3,984,932 A 10/1976 Morton
4,166,333 A 9/1979 Kratzer
4,296,565 A 10/1981 Jaffin et al.
4,430,820 A 2/1984 Marsh
4,594,803 A 6/1986 Muncy
4,621,444 A * 11/1986 Anderson ..... F41A 9/56 42/98
4,715,141 A 12/1987 Kohnke
5,664,727 A 9/1997 Beall
5,811,716 A 9/1998 Ellzey
5,934,002 A 8/1999 Blanchet
6,487,808 B1 12/2002 Carey
D482,425 S * 11/2003 Cunningham ..... D22/108
6,701,659 B1 3/2004 Langner
7,043,863 B2 5/2006 Saur
7,134,233 B1 11/2006 Saur
7,389,605 B1 6/2008 Clark
7,395,626 B2 7/2008 Zedrosser
7,536,821 B1 5/2009 Saur
8,006,609 B2 8/2011 Kallio et al.
8,448,363 B2 5/2013 Fargnoli et al.
2005/0235543 A1 10/2005 Murello
2007/0289191 A1* 12/2007 Cowan ..... F41C 23/02 42/90
2012/0023803 A1 2/2012 Taylor
2012/0240754 A1 9/2012 James
2012/0266514 A1* 10/2012 Michal ..... F41C 23/16 42/90

(Continued)

*Primary Examiner* — Samir Abdosh
(74) *Attorney, Agent, or Firm* — Mersenne Law

(57) ABSTRACT

Shell deflectors or redirectors according to embodiments of the invention block a shell ejected from a firearm after firing, absorb some of its kinetic energy to cause the shell to slow down, and reflect or redirect the shell to a convenient area near the shooter, thus simplifying cleanup and brass-collection after operating the firearm.

10 Claims, 5 Drawing Sheets

(56) References Cited

U.S. PATENT DOCUMENTS

| | | | |
|---|---|---|---|
| 2015/0253092 | A1 | 9/2015 | Moskovitch |
| 2015/0369553 | A1 | 12/2015 | Stussak |

* cited by examiner

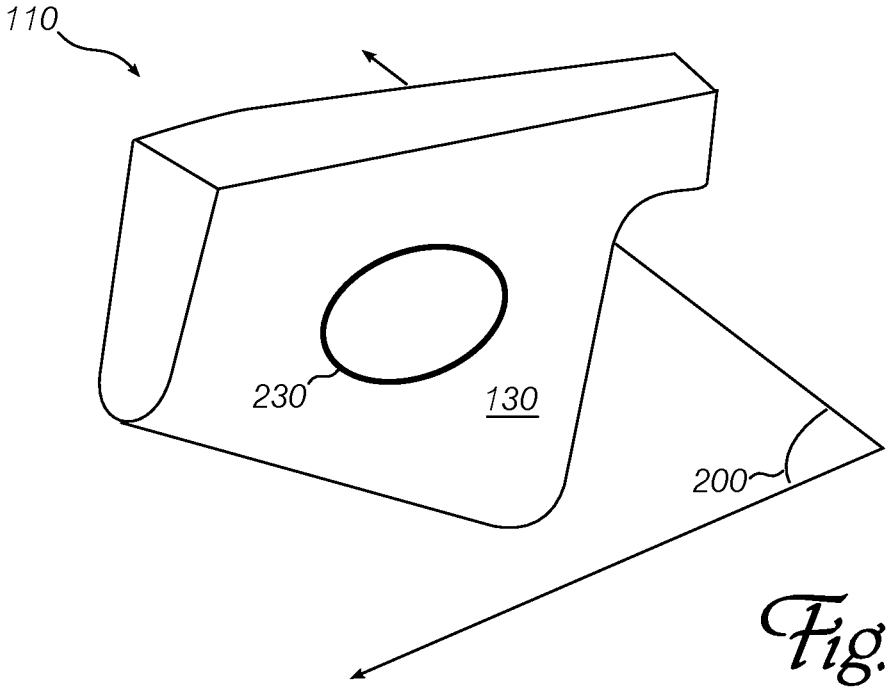
Fig. 2
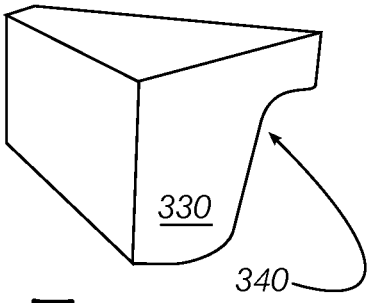
Fig. 3
Fig. 4
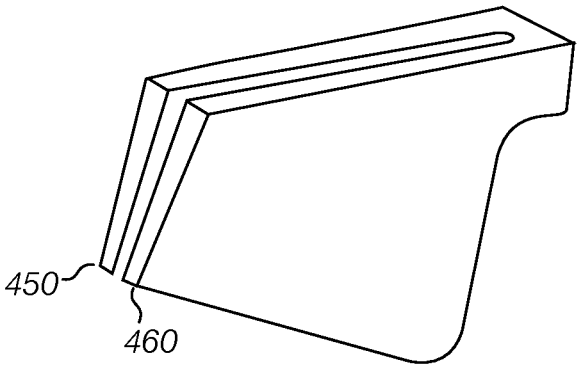

CONTROL OF EJECTED FIREARM SHELLS

CONTINUITY AND CLAIM OF PRIORITY

This is an original U.S. patent application.

FIELD

The invention relates to accessories for improved convenience in operating automatic and semi-automatic firearms. More specifically, the invention relates to accessories for altering the trajectory of spent shells ejected from an automatic or semi-automatic firearm so that they fall nearer the shooter, and nearer each other.

BACKGROUND

Most conventional firearms rely on rapidly-expanding gasses created by rapid or explosive combustion of a material such as gunpowder to drive a projectile through a barrel and towards a target. This process is somewhat inefficient: not all of the energy in the explosion can be transferred to the projectile. However, some firearms make use of a portion of the energy to operate other mechanisms needed by the firearm. For example, semi-automatic and automatic firearms use a portion of the gas pressure to cycle the action, ejecting the spent cartridge and loading the next round. The trigger mechanism is also re-armed (and in an automatic firearm, the next round is fired if the trigger is still engaged).

Spent shells typically leave the ejection port with a fair amount of energy and fly some distance from the gun. In addition, since they are often oddly shaped and balanced, and made of a hard, springy material such as brass, they bounce and roll randomly, coming to rest over an inconveniently large area. This makes recovery of the shells for cleanup and/or reloading more difficult, particularly when a large number of rounds are fired in a short period of time (such as during target practice).

Prior-art methods to capture and/or collect ejected brass typically attach a bag or other receptacle to the gun (e.g., U.S. Pat. No. 4,166,333 to Kratzer, U.S. Pat. No. 4,715,141 to Kohnke; U.S. Patent Application Publication No. 2012/0023803 by Taylor), or place it on a stand nearby, with an opening positioned and sized to catch shells in flight (U.S. Pat. No. 3,658,241 to Pistocchi). However, these approaches are suboptimal because they interfere with the normal operation of the gun as the weight of collected brass increases, or they require that the shooter remain near the collecting bag so that ejected shells travel into the opening. New approaches for controlling ejected firearm shells may be of significant value in this field.

SUMMARY

Embodiments of the invention are small structures designed to mount to a particular model or style of firearm in a predetermined location, where they block or obstruct the flight of a spent shell ejected from the firearm, absorb some of its kinetic energy, and deflect the shell so that it is more likely to land in a predetermined area near the shooter (and to stay near where it lands, rather than bouncing or rolling away). Since the brass tends to collect in a smaller, nearby area, cleanup is much easier. In addition, embodiments may be useful to reduce interference with other neighboring shooters (whether in practice or combat situations).

BRIEF DESCRIPTION OF DRAWINGS

FIG. 2 shows an enlarged view of an embodiment.

FIG. 3 shows a wedge-shaped embodiment.

FIG. 4 shows a multiple-fin embodiment.

DETAILED DESCRIPTION

Embodiments of the invention were developed for AR-15 model firearms (it is appreciated that many variations of this gun exist, but the differences required of an embodiment to accommodate the variations are within the level of ordinary skill in the art, once the person has reviewed and understood this disclosure). Embodiments for other automatic and semi-automatic firearms can also be constructed according to the principles described herein. Both handguns and long guns may benefit.

Figure 1A:
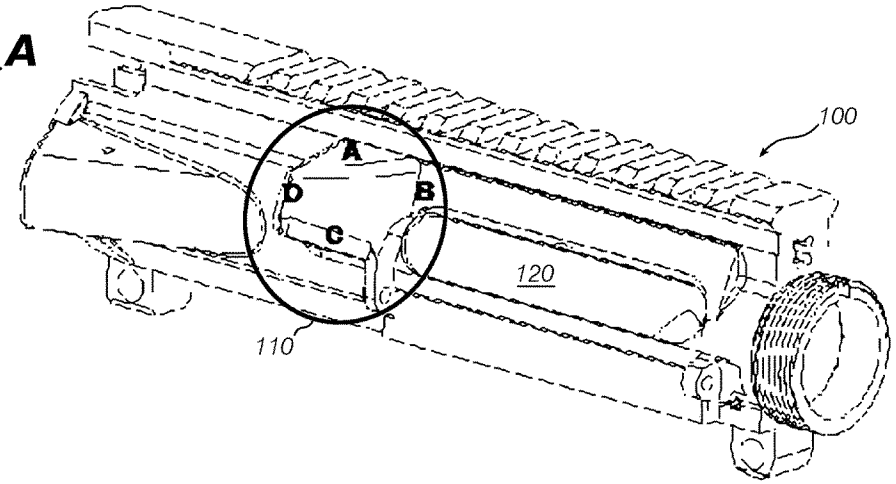
FIGS. 1A-c show an embodiment of the invention suitable for an AR-15-style firearm.
Figure 1B:
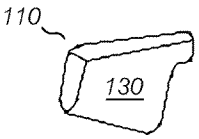
Figure 1C:
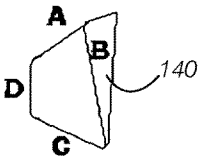

FIG. 1A shows an upper receiver for an AR-15-style firearm 100. An embodiment of the invention 110 is affixed to the upper receiver just aft of the ejection port 120. FIG. 1B shows the embodiment 110 alone, and FIG. 1*c* shows the embodiment from another perspective. In FIG. 1B, a deflecting surface of the embodiment is identified at 130. In FIG. 1*c*, a mounting surface 140 is visible. The mounting surface is shaped to complement the surface of the firearm against which the embodiment is to be coupled. In this embodiment, mounting surface 140 is shaped to complement the profile of the upper receiver 100 just behind the ejection port.

It is appreciated that some varieties of AR-15 upper receivers have a wedge-shaped protrusion formed in the metal of the receiver, behind the ejection port. This wedge functions as a shell deflector, but its primary purpose is simply to prevent ejected shells from flying into the operator's face. An embodiment of the invention may be used with a firearm already having an existing deflector. The embodiment may be secured to the firearm away from the deflector, near the deflector, partly touching the deflector, or mounted substantially on the deflector. Shells may travel from the ejection port and strike the deflector before striking the embodiment, or the embodiment may be placed ahead of the deflector so that only the embodiment is struck. An embodiment of the invention differs from a simple, built-in deflector in several ways.

First, a deflector according to an embodiment is formed from a tough but slightly compliant material such as nylon, polyurethane, polyethylene, silicone, natural or synthetic rubber. These materials absorb some kinetic energy from an impacting projectile, causing the projectile to slow down. In an embodiment, this means that an ejected shell that strikes the deflector will lose some of its energy and travel a smaller distance from the firearm than it would if the deflector was absent.

Second, a deflector according to an embodiment is structured so that the surface impacted by an ejected shell is angled to cause the shell to bounce toward a target collection area near the shooter (rather than simply being deflected away from an undesired area, such as the shooter's face). The result of this combination of compliant material and deflecting surface orientation is that ejected shells tend to come to rest closer to the shooter, and to bounce or scatter over a smaller area than they would without an embodiment of the invention.

FIG. 2 shows an enlarged version of the embodiment of FIG. 1. The device 110 should be sized and constructed so that the deflection face 130 is held at a predetermined angle 200 to the mounting face (not visible in this view), so that ejected shells tend to strike the deflector near the middle of the deflection face (e.g., at 230). (If the deflection face is too small, or shell ejection is too irregular with respect to a particular size of deflection face, then some shells may strike the edge of the deflector and be scattered away from the desired collection area.) The deflection face may be flat or slightly concave, to improve the uniformity of shell trajectory. (It is appreciated that empty firearm shells are unbalanced and aerodynamically unstable, so it is impossible to achieve perfect uniformity of trajectory. However, if the deflector is positioned so that the ejected shell strikes it soon after leaving the firearm, the shell will not have had time to tumble significantly, so its directed deflection by an embodiment may be more consistent.)

Deflectors according to an embodiment may be shaped or constructed differently, provided that the mounting face can be securely affixed to a predetermined location on the firearm, and that the deflection face is located suitably to absorb some impact energy from ejected shells and alter the trajectory of the shells so they land nearby. For example, FIG. 3 shows a more wedge-shaped embodiment with a larger mounting face 340 (behind the illustrated wedge). Deflection surface 330 is similarly sized and oriented. FIG. 4 shows another alternate embodiment: instead of a single "fin" deflector, this embodiment comprises two thinner flaps 450 and 460. The front flap 460 may endure most of the impact from ejected shells, and may bend to absorb some of a shell's energy. The two-flap design may be less likely to catch and snag than a stiffer single-fin version.

Embodiments may be secured to a predetermined location on a firearm by means of a pressure-sensitive adhesive, an acrylate or cyanoacrylate adhesive, an epoxy adhesive (such as a two-part epoxy), or by screws or similar fasteners. A removeable version may be secured in place using a hook-and-loop fastener, although this is less favorable (it is not as secure, and the mounting-face-to-deflection-face angle and position cannot be maintained as consistently.)

Figure 5:
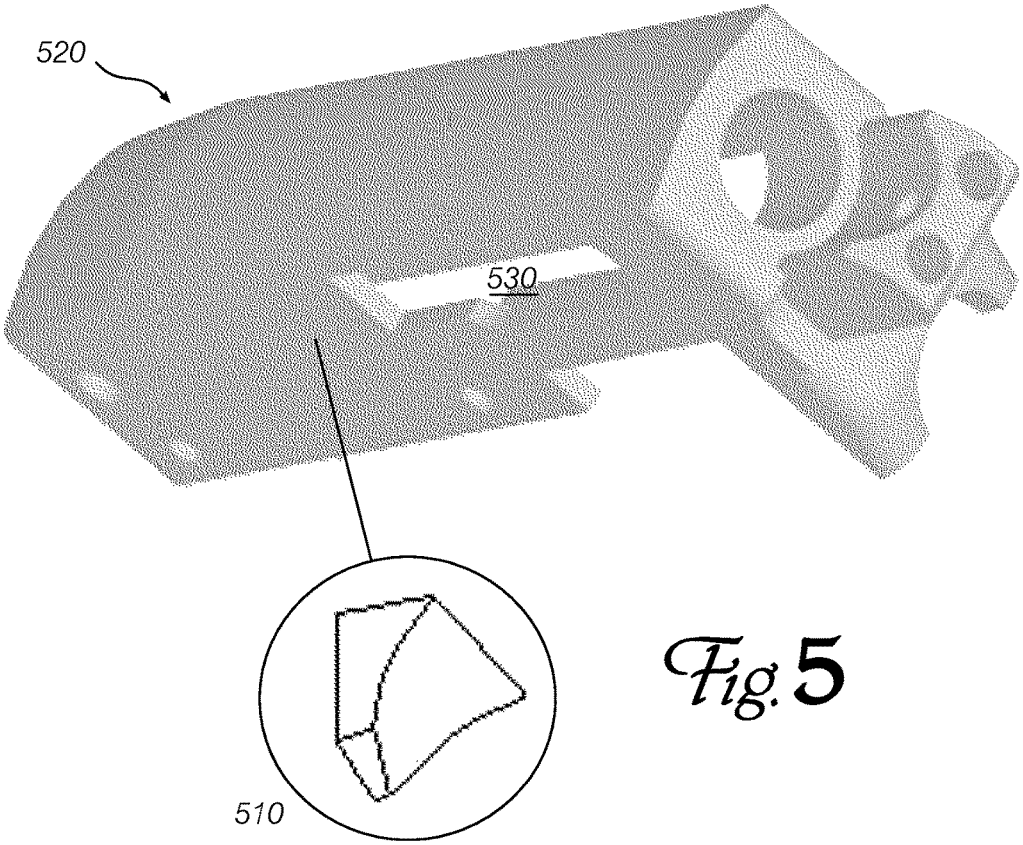
FIG. 5 shows an embodiment suitable for a different firearm.
Figure 6:
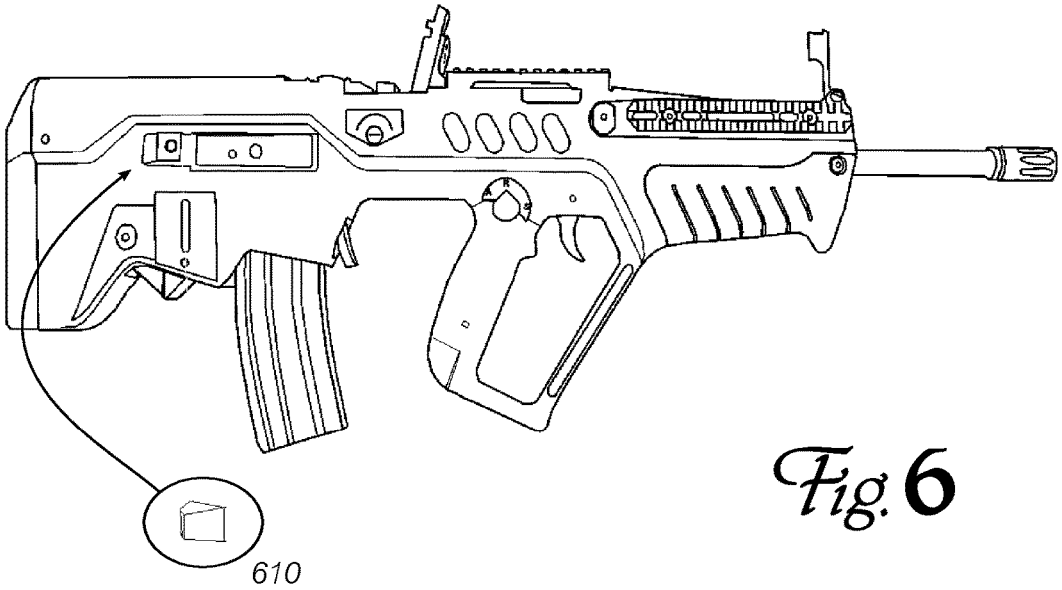
FIG. 6 shows an embodiment suitable for yet another firearm.

FIG. 5 shows a single-fin embodiment 510 suitable for a Ruger firearm, and FIG. 6 shows a wedge-shaped embodiment 610 for a TAR-21 assault rifle. All of these embodiments comprise a first surface configured to complement and couple to a predetermined location of a firearm, and a second surface sized, positioned and oriented to block the normal trajectory of a shell ejected from the firearm and cause the shell to travel along a different trajectory. The first and second surfaces are held in a static relationship by the construction of the deflector. For example, the deflector may be formed as a single solid (or hollow) structure, which holds the deflection surface in the desired position when the deflector is secured to the firearm in the predetermined location.

Figure 7:
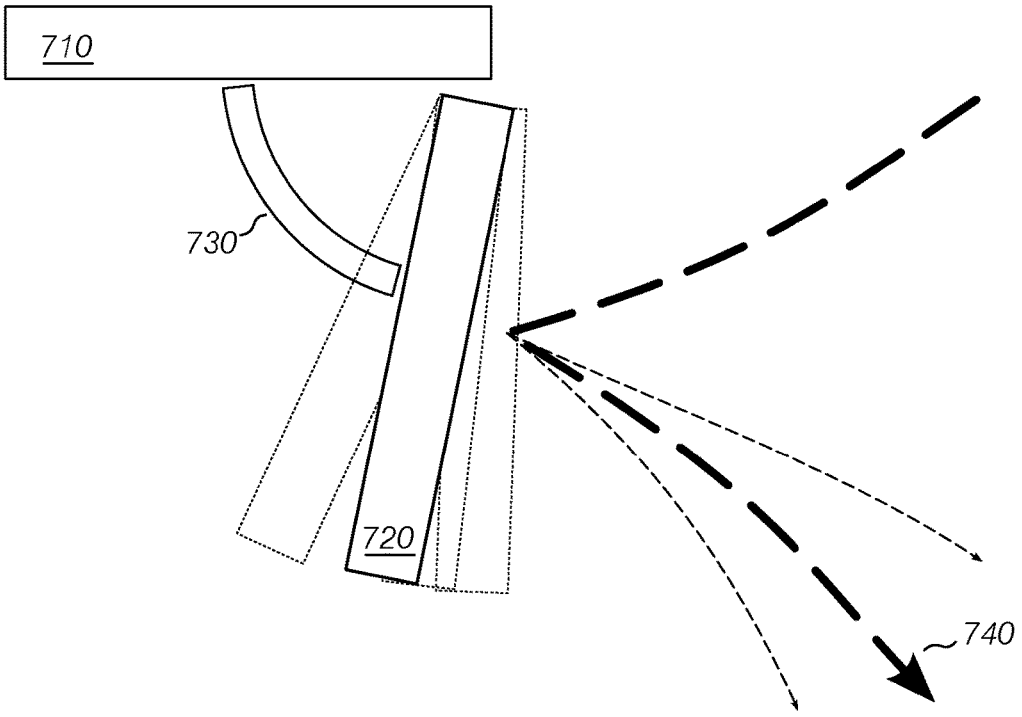
FIG. 7 shows how an adjustable embodiment may be configured.

Finally, although the preceding embodiments have been monolithic, solid (or hollow) unitary structures without adjustment, an embodiment may provide an adjustable linkage such as a malleable support stem, a ball-and-socket connection, or a thermoplastic (heat-moldable) armature connecting the mounting surface and the deflecting surface so that the position and/or angle of the deflecting surface can be modified to change the direction towards which ejected-shell trajectories are adjusted. FIG. 7 shows such an embodiment (in representative form): a mounting surface 710 is coupled to a deflecting surface 720 through an adjustable linkage 730. Mounting surface 710 is secured to the firearm in a suitable location, but deflecting surface 720 can be moved and angled so that ejected shells follow preferred trajectories 740. This adjustability may improve function for a modified firearm, a firearm using non-standard ammunition, or a firearm being operated in an unusual position.

Figures 8, 9:
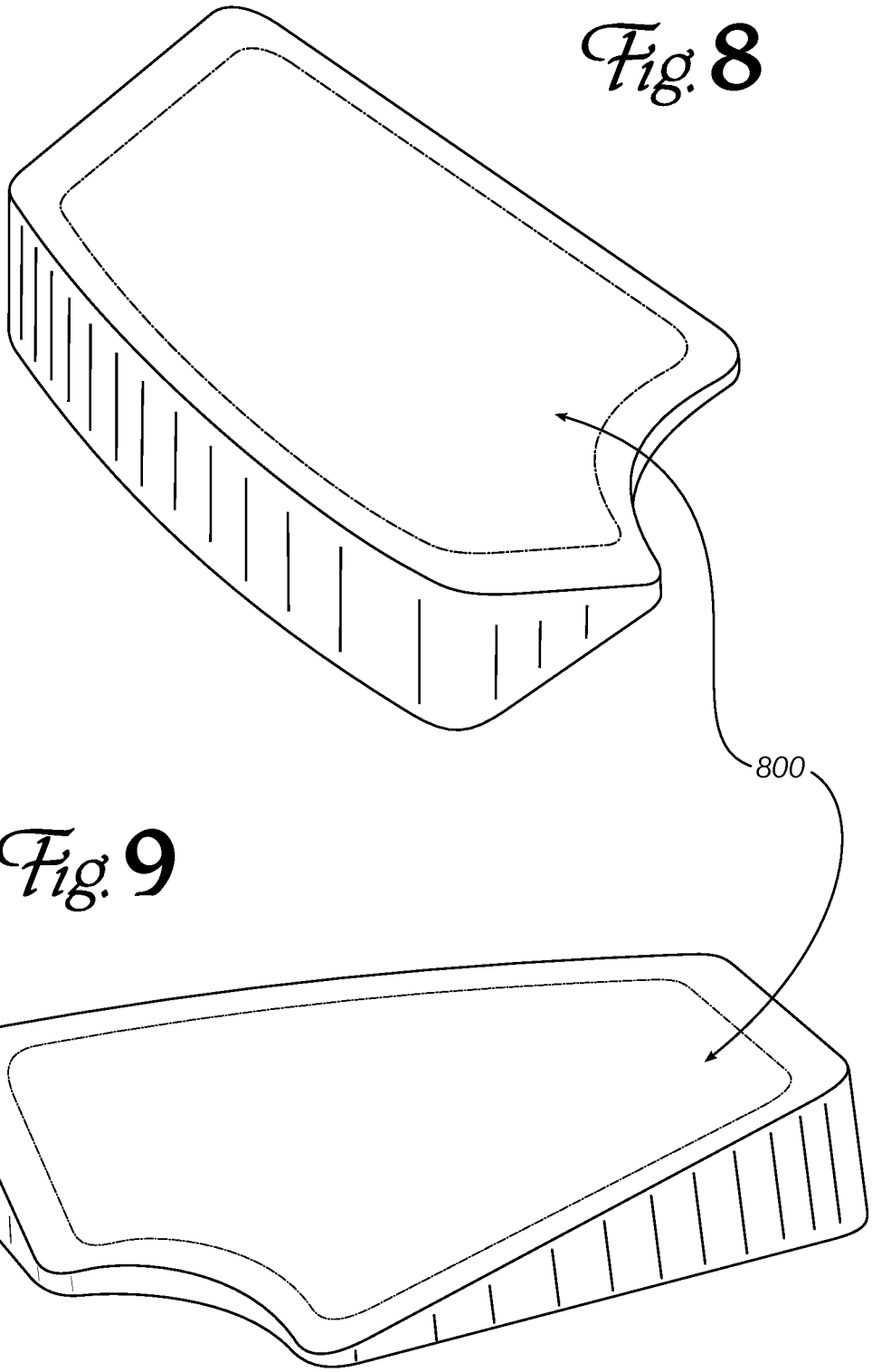
FIGS. 8 & 9 show two perspective views of a wedge-shaped embodiment.

FIGS. 8 & 9 show two different perspective views of a fin-shaped embodiment. Reference character 800 indicates a protective film that may be applied to a front surface of the embodiment. The film may be, for example, transparent, reflective or colored polyester film (the commonly-available Mylar® film from DuPont-Teijin is a suitable film).

The features of the present invention have been described largely by reference to specific examples for use on an AR-15 semi-automatic rifle. However, those of skill in the art will recognize that beneficial spent-cartridge control can also be achieved by differently-shaped and -positioned deflectors, provided that such deflectors have the key features identified above, and as recited the following claims.

We claim:

1. A shell deflector comprising:

a unitary structure formed from a durable material having a mounting surface and a deflection surface, wherein the mounting surface is shaped to complement a predetermined, non-reciprocating mounting area of a firearm, and the deflection surface is positioned in relation to an ejection port of the firearm when the mounting surface is affixed to the predetermined mounting area so that a shell ejected from the firearm will collide with the deflection surface, lose kinetic energy in the collision, and rebound from the deflection surface in a different direction from an original ejection direction, wherein the deflection surface comprises a flexible fin, and wherein displacement of the flexible fin upon impact from the shell is effective to reduce the kinetic energy of the shell.

2. The shell deflector of claim 1 wherein the durable material is one of nylon, polyurethane, polypropylene, synthetic rubber or natural rubber.

3. The shell deflector of claim 1 wherein the unitary structure is substantially solid.

4. The shell deflector of claim 1, further comprising a pressure-sensitive adhesive to affix the mounting surface to the predetermined mounting area of the firearm.

5. A shell deflector comprising:

a unitary structure formed from a durable material having a mounting surface and a deflection surface, wherein the mounting surface is shaped to complement a predetermined mounting area of a firearm having a separate and independent deflector, distinct from the unitary structure, and the deflection surface is positioned in relation to an ejection port of the firearm when the mounting surface is affixed to the predetermined mounting area so that a shell ejected from the firearm will strike the separate and independent deflector, then collide with the deflection surface, lose kinetic energy in the collision, and rebound from the deflection surface in a different direction from an original ejection direction.

6. A shell deflector comprising:

a unitary structure formed from a durable material having a mounting surface and a deflection surface, wherein the mounting surface is shaped to complement a predetermined, non-reciprocating mounting area of a firearm, and the deflection surface is positioned in relation to an ejection port of the firearm when the mounting surface is affixed to the predetermined mounting area so that a shell ejected from the firearm will collide with the deflection surface, lose kinetic energy in the collision, and rebound from the deflection surface in a different direction from an original ejection direction, wherein the firearm comprises a separate and independent deflector, distinct from the unitary structure, wherein the unitary structure is positioned so that the shell ejected from the firearm strikes the separate and independent deflector before colliding with the deflection surface of the unitary structure.

7. The shell deflector of claim 6 wherein the predetermined mounting area of the firearm includes a portion of the separate and independent deflector.

8. The shell deflector of claim 6, further comprising a pressure-sensitive adhesive to affix the mounting surface to the predetermined mounting area of the firearm.

9. The shell deflector of claim 6 wherein the durable material is one of nylon, polyurethane, polypropylene, synthetic rubber or natural rubber.

10. The shell deflector of claim 1 wherein the unitary structure is substantially solid.

* * * * *